US011651927B2

(12) United States Patent
Tuohimaa et al.

(10) Patent No.: US 11,651,927 B2
(45) Date of Patent: May 16, 2023

(54) ELECTRON COLLECTOR WITH OBLIQUE IMPACT PORTION

(71) Applicant: Excillum AB, Kista (SE)

(72) Inventors: Tomi Tuohimaa, Kista (SE); Ulf Lundström, Kista (SE); Björn Hansson, Kista (SE)

(73) Assignee: EXCILLUM AB, Kista (SE)

( * ) Notice: Subject to any disclaimer, the term of this patent is extended or adjusted under 35 U.S.C. 154(b) by 184 days.

(21) Appl. No.: 17/297,126

(22) PCT Filed: Dec. 17, 2019

(86) PCT No.: PCT/EP2019/085559

§ 371 (c)(1),
(2) Date: May 26, 2021

(87) PCT Pub. No.: WO2020/127201

PCT Pub. Date: Jun. 25, 2020

(65) Prior Publication Data

US 2022/0028645 A1 Jan. 27, 2022

(30) Foreign Application Priority Data

Dec. 20, 2018 (EP) ..... 18214663

(51) Int. Cl.
*H01J 35/14* (2006.01)
*H05G 1/52* (2006.01)

(52) U.S. Cl.
CPC ..... *H01J 35/147* (2019.05); *H05G 1/52* (2013.01); *H01J 2235/082* (2013.01)

(58) Field of Classification Search
CPC .... H01J 35/147; H01J 35/02; H01J 2235/082; H01J 35/153; H01J 35/14; H01J 35/08;
(Continued)

(56) References Cited

U.S. PATENT DOCUMENTS 7,971,465 B2 7/2011 Eigler et al.
10,818,468 B1 * 10/2020 Hansson ..... H01J 35/18
(Continued)

FOREIGN PATENT DOCUMENTS

DE 102013220189 A1 4/2015
JP S5517928 A 2/1980
(Continued)

OTHER PUBLICATIONS

International Search Report (PCT/ISA/210) and Written Opinion (PCT/ISA/237) dated Mar. 12, 2020, by the European Patent Office as the International Searching Authority for International Application No. PCT/EP2019/085559.

*Primary Examiner* — Irakli Kiknadze

(74) *Attorney, Agent, or Firm* — Buchanan Ingersoll & Rooney P.C.

(57) ABSTRACT

An X-ray source including a liquid target source configured to provide a liquid target in an interaction region of the X-ray source, an electron source adapted to provide an electron beam directed towards the interaction region, such that the electron beam interacts with the liquid target to generate X-ray radiation, and an electron collector arranged at a distance downstream of the interaction region, as seen along a travel direction of the electron beam. The electron collector includes an impact portion configured to absorb electrons of the electron beam impinging thereon, and the impact portion is arranged so as to be oblique with respect to the travel direction of the electron beam at the impact portion.

15 Claims, 5 Drawing Sheets

(58) Field of Classification Search
CPC .... H01J 2235/168; H01J 35/12; H01J 35/065; H01J 2235/06; H01J 2235/086; H01J 2235/062; H01J 35/066; H01J 35/064; H01J 35/045; H01J 35/112; H01J 35/06; H01J 35/10; H01J 35/18; H01J 3/022; H01J 2235/16; H01J 2235/18; H01J 2235/068; H05G 1/52; H05G 1/265; H05G 1/46; H05G 1/02; A61B 6/40; A61B 6/032; A61B 6/56; G01N 23/201; G01N 23/20008; G01N 2223/204; G01N 2223/054; G01N 2223/1016; G01N 2223/6116; G01N 2223/03; G03F 7/70633

USPC ..... 378/138
See application file for complete search history.

(56) References Cited

U.S. PATENT DOCUMENTS

| | | | | |
|---|---|---|---|---|
| 2004/0262533 | A1 | 12/2004 | Krueger | |
| 2012/0138812 | A1 | 6/2012 | Oving | |
| 2013/0075624 | A1 | 3/2013 | Hwang et al. | |
| 2016/0120012 | A1 | 4/2016 | Heid | |
| 2017/0345611 | A1 | 11/2017 | Heid | |
| 2019/0131103 | A1* | 5/2019 | Tuohimaa | H01J 35/20 |
| 2020/0058461 | A1* | 2/2020 | Takman | H05G 1/265 |
| 2020/0367351 | A1* | 11/2020 | Tuohimaa | H05G 1/54 |
| 2021/0195724 | A1* | 6/2021 | Takman | H01J 35/153 |

FOREIGN PATENT DOCUMENTS

| | | | |
|---|---|---|---|
| KR | 20150114039 | A | 10/2015 |
| WO | 2012087238 | A1 | 6/2012 |

* cited by examiner

ELECTRON COLLECTOR WITH OBLIQUE IMPACT PORTION

TECHNICAL FIELD

The invention disclosed herein generally relates to electron-impact X-ray sources in which an electron beam interacts with a target to generate X-ray radiation. In particular, the invention relates to techniques and devices for collecting the electron beam downstream of the target.

BACKGROUND

X-ray radiation may be generated by directing an electron beam onto a target. In such system, an electron source comprising a high-voltage cathode is employed to produce an electron beam that impinges on the target at an impact region inside a vacuum chamber. The target is typically provided as a liquid jet, such as a liquid metal jet, propagating through the interaction region.

Behind the target, as seen in the propagation direction of the electron beam, an electron collector may be arranged to take care of electrons of the electron beam that pass the interaction region/target. The collector can be an electron dump for absorbing electrons and their kinetic energy, and/or a sensor for characterising the electrons passing the interaction region.

In either case it is important to ensure proper thermal management of the collector to avoid heat induced damages caused by the absorbed electrons. This is of particular relevance when increasing the power density of the electron beam in order to meet the general strive for higher performance and brilliance of the X-ray source.

Thus, there is a need for X-ray sources and collectors capable of handling an increasing thermal load.

SUMMARY

It is an object of the present invention to provide an X-ray source in which the thermal management of the electron collector is improved. It is envisaged that the invention will, as a consequence, help such sources to operate with higher performance without damaging the electron collector material.

According to a first aspect of the present invention, there is provided an X-ray source comprising a liquid target source configured to provide a liquid target in an interaction region of the X-ray source, an electron source adapted to provide an electron beam directed towards the interaction region, such that the electron beam interacts with the liquid target to generate X-ray radiation, and an electron collector arranged at a distance downstream of the interaction region, as seen along a travel direction of the electron beam. The electron collector comprises an impact portion configured to absorb electrons of the electron beam impinging thereon. The impact portion is arranged so as to be oblique with respect to the travel direction of the electron beam at the impact portion.

According to a second aspect, there is provided a method in an X-ray source configured to generate X-ray radiation upon interaction, in an interaction region, between an electron beam and a liquid target. The method comprises the steps of directing the electron beam towards the interaction region, and impacting the electron beam on an impact portion of an electron collector arranged at a distance downstream of the interaction region, as seen along a travel direction of the electron beam. The impact portion is oblique with respect to the travel direction of the electron beam at the impact portion.

As the electrons of the electron beam hits the impact portion of the electron collector, at least a part of their energy will be absorbed by the electron collector and converted into thermal energy. The electron collector may be affected by at least two factors: the total amount of thermal energy transferred to the electron collector, and the power distribution over a specific portion of the electron collector. These two factors will be discussed in the following.

The total amount of transmitted energy may be understood as a general heating of the electron collector. A proper heat dissipation, or heat transfer from the electron collector may ensure that the average temperature of the collector is kept within a suitable range. The heat transfer may for example employ active cooling realized by actively circulated cooling fluids, or passive cooling realized by heat sinks or cooling flanges arranged in thermal contact with the collector. Generally, the total power of the electron beam is the determining factor for the overall heating of the collector and may hence be controlled in order to avoid overheating of the collector.

The power distribution over a specific portion of the collector may be understood as a power density determined as the ratio between the total power of the electron beam and the area of the spot formed by the electron beam on the impact portion. Alternatively, the maximum power supplied to each point of the impact portion may be considered instead. If it is assumed that there is a damage threshold, at which thermally induced damages of the collector material can occur, the X-ray source can be operated below this threshold either by reducing the total power of the electron beam or by reducing the maximum power density.

The present invention provides a solution based on the latter, i.e., by reducing the maximum power density. This is achieved by arranging the impact portion such that the surface area on which the electrons impinge the collector is larger than a cross sectional area of the electron beam, taken orthogonal to the travel direction of the beam. This may be achieved by arranging the impact portion such that it is oblique with respect to the travel direction of the electron beam at the impact portion, i.e., such that the impact portion is non-orthogonal to the electron beam, and/or by providing the impact portion with a surface structure that increases the area of the impact portion. Increasing the area of the impact portion, and thus the electron spot, results in a reduced power density. As a consequence, the total power of the electron beam can be increased without risking to exceed the damage threshold.

It is appreciated that the angle of incidence of the electron beam (measured in relation to the normal of the surface of the impact portion) may affect the scattering of the electrons. An increasing angle of incidence may result in an increasing number of electrons that are back-scattered upon impact, whereas a decreasing angle of incidence may result in a reduced scattering. An increased scattering may be advantageous in terms of thermal load, since it may reduce the absorbed current and hence the absorbed thermal energy. It may however be desirable to collect as many of the incoming electrons as possible in order to control the number of back-scattered electrons present in the chamber and to increase the accuracy of the measurements in case the collector is used as a detector or sensor. The increased scattering that may be a result of the oblique orientation of the impact portion may in that case be compensated by adding electron capturing structures to the collector, such as apertures or recesses, for collecting the scattered electrons. Exemplifying embodiments will be discussed in further detail in connection with the drawings.

The impact portion may be defined by the area or region of the collector in which at least a part of the electron beam impinges on the collector. The lateral extension of the impact portion may thus be determined by a width of the electron spot formed on the collector by the impinging electron beam. The lateral extension may be increased by tilting the impact portion such that the angle of incidence of the electron beam is increased. For an electron beam with circular cross section, this will result in a spot that is elliptical or oval, whereas it for an electron beam with a line-shaped cross section will result in a spot that is thicker or longer, depending on in which direction the impact portion is tilted.

It will however be appreciated that the impact portion may refer to the entire surface defined by the electron spot, or to a portion of the surface covered by the spot. Thus, the electron spot may in some examples cover one or several impact portions of the collector, wherein each one of the impact portions may have a different orientation with respect to the electron beam. In other words, the same electron beam may impinge on the collector at a plurality of different angles of incidence. This may for example be achieved by a pyramidal structure, wherein each side of the pyramids may form an impact portion that is oblique with respect to the travel direction of the electron beam at the impact portion.

The impact portion may in some examples be formed by a two-dimensional surface. The obliqueness of such a surface can be defined by the angle between its normal and the travel direction of the electron beam at the impact portion. The angle should be greater than zero degrees so as to provide an increased spot when the cross section of the electron beam is projected onto the surface, and preferably less than 90 degrees so as to ensure a projection at all.

Alternatively, the impact portion may be formed by a three-dimensional surface, which for example may conform to a cylinder or a sphere. In such cases, the obliqueness of the impact portion may be determined by the angle between the travel direction of the electron beam at the impact portion and the normal to a tangent plane to a centre point of the impact portion.

Put differently, the impact portion may be arranged such that the area of the electron spot, when projected onto the impact portion, exceeds its minimum.

The impact portion may be formed of a substantially smooth surface coinciding with the two- or three-dimensional surfaces discussed above. It will however be appreciated that the impact portion may comprise a surface structure, such as recesses, protrusions or steps. In those cases, the terms "two-dimensional surface" and "three-dimensional surface" as discussed above in connection with obliqueness may refer to an average surface of the impact portion. The average surface may for example be a two-dimensional surface approximation of the actual impact portion, and the obliqueness, or angle of incidence, may be defined by a normal to a tangent plane to a centre point of the impact portion.

In an example the actual surface of the impact portion may be formed as a terrace or step-like surface. The obliqueness of this surface may be determined by the normal to an average plane that is fitted to the actual surface.

For the purpose of the present application, the term "oblique" is used in the sense neither parallel nor at right angles to the travel direction of the electron beam at the impact portion. The travel direction may in some examples refer to an optical axis of an electron-optic system arranged to control the electron beam. The travel direction of the electron beam at the impact portion may be referred to as the impact direction. The impact portion may be considered as oblique if a cross section of the electron beam is distorted when projected onto the impact portion. Other terms, such as "slanting" or "arranged at an angle" may be used interchangeably throughout the present disclosure. The term angle of incidence should be understood as the angle between an average plane of the impact portion and a centre line of the electron beam along the impact direction. For a flat surface, the average plane is the same as the impact portion whereas for a structured surface the average plane may be seen as a baseline upon which the structures are defined. For a curved surface, the average plane corresponds to a tangent plane at centre point of the electron beam at the impact portion.

The electron collector may be referred to as an electron dump, referring to a primary function of absorbing electrons of the electron beam. Alternatively, or additionally, the collector may be referred to as a detector or sensor for characterizing electrons impinging thereon. The collector may be provided with an electrical connection for allowing the absorbed electrons to be transported away as an electrical current. In case the collector functions as a sensor, the current may be measured so as to detect or quantify the absorbed electrons. The sensor may be an arrangement suitable for detecting the presence (and, if applicable, power or intensity) of an electron beam impinging on the sensor. To mention a few examples, the electron collector may be or comprise a charge-sensitive area (e.g. conductive plate earthed via an ammeter), a scintillator, a light sensor, a charge-coupled device (CCD), or the like).

Preferably, the impact portion of the electron collector is centred on an electron-optical axis of the X-ray source, and downstream or behind the interaction region (as seen from the electron source) so as to ensure that the electron beam is allowed to impinge on the impact portion.

By "liquid target" or "liquid anode" may be understood a liquid jet, or flow of liquid being forced through a nozzle and propagating through an interior of a vacuum chamber of the X-ray source. The position in space in which a travel direction of the liquid target intersects the travel direction of the electron beam may be referred to as the interaction region. Even though the liquid target in general may be formed of an essentially continuous flow or stream of liquid, it will be appreciated that the jet additionally, or alternatively, may comprise or even be formed of a plurality of droplets. Further embodiments of the liquid target may include multiple jets, which may be arranged to sequentially or simultaneously interact with one or several electron beams.

It will be appreciated that the liquid for the target may be a liquid metal, preferably with a low melting point, such as for example indium, tin, gallium, lead or bismuth, or alloys thereof. Further examples or liquids include water and methanol.

According to some embodiments, the impact portion may comprise a surface structure for reducing an absorbed power density delivered by the impinging electron beam. The surface structure may for example be a folded structure, or stepped structure, increasing the surface area of the impact portion.

According to an embodiment, the impact portion may be arranged so as to allow the electron beam to impinge thereon on at an angle of incidence that is selected such that an absorbed power density is reduced by at least a reduction factor compared to the case in which the impact portion is orthogonal to the impact direction. Such a reduction may for example be obtained by arranging the impact portion such that a cross section of the electron beam is increased at least by a similar factor when forming an electron spot on the impact portion. Provided that the local angle of incidence for the incoming electron beam is not normal to the impact portion, the absorbed power may be reduced. Thus, in such embodiments the objective of reducing the absorbed power density by said reduction factor may be realized without increasing the cross section of the electron beam by the same factor. The reduction factor may be at least five, such as at least ten. The angle of incidence may be selected within the range from 1.5 degrees to 30 degrees, such as from 3 degrees to 20 degrees, such as from 3 degrees to 10 degrees.

According to an embodiment, the impact portion is configured to accommodate the entire cross section of the electron beam. This configuration may be achieved by selecting an impact portion having an area that is larger than the area of the electron spot, and/or by selecting an angle of incidence that results in a projected electron spot that is not larger than the impact portion. The present embodiment is advantageous in that it allows for the entire electron beam, or at least its entire cross section, to impinge on the impact portion. This facilitates absorption of electrons and a more accurate measurement of the current provided by the electron beam.

According to some embodiments, the impact portion may form part of an inner surface of a recess or depression extending into a body of the electron collector. The recess may for example be a bore or a channel forming a blind hole in the electron collector. Since the electron collector will be arranged within the vacuum chamber, the hole in the electron collector cannot in a real sense be open. The bottom of the hole may be provided as part of another member than the hole itself but for all practical purposes the hole must be considered as a blind hole. The cross-section of the hole may have many shapes and need not be constant along the length of the bore. The recess may be employed in order to capture scattered electrons and thereby provide a relatively higher absorption. This is an advantage when using the collector as a sensor, since the reduced back-scattering will manifest itself as a relatively higher response in terms of signal level to a given amount of irradiated charge. The recess can be made deeper (and possibly narrower) to increase the absorption ratio and improve the quality of the measured signal.

According to an embodiment, the bore may be oriented at an angle that prevents the electron beam from directly impinging on the bottom of the bore. In other words, the impact portion formed by the side surface of the bore, may be oriented such that it can accommodate the entire cross section of the electron beam. Electrons scattered from the impact portion may reach the bottom of the bore without risk of overheating since they will have lost energy during the scattering events and furthermore the electron density will be reduced due to absorption and scattering. The bore should be arranged so that there is no direct path for the electron beam to reach the bottom of the bore without experiencing at least one scattering event at the impact portion.

According to an embodiment, the entrance of the recess may be provided with a tapered or funnel-shaped surface portion so as to guide electrons into the recess.

According to some embodiments, the X-ray source may comprise an aperture arranged upstream of the entrance of the recess. The aperture may be provided to capture back-scattered electrons, and may in one example be smaller than a cross section of the recess. The aperture may serve the purpose of providing a known size and/or position reference that can be used during alignment and width measurement of the electron beam. The aperture may further limit which parts of the electron collector the electron beam can reach, thereby preventing local overheating of the electron collector.

According to some embodiments, the X-ray source further comprises a cooling arrangement for transporting away heat from the electron collector.

The cooling arrangement may for example comprise a cooling channel for guiding a cooling fluid through the collector. The cooling fluid may in some examples be de-ionized.

According to an embodiment, the X-ray source may comprise an arrangement for measuring a current absorbed by the electron collector. The arrangement may for example include an ammeter configured to generate a signal representing the current. Furthermore, the electron collector may be electrically insulated from the rest of the system to ensure that all current passes through the ammeter. The impact portion may be divided into a plurality of sub-portions electrically insulated from each other and connected to one ammeter each. By measuring the current passing through each respective sub-portion, one may calculate where on the impact portion the electron beam impacts. This information may be used when aligning the electron beam.

The measured current may be used to calculate an absorbed power density delivered by the electron beam. Under the assumption that a negligible fraction of the incoming electrons is scattered away from the collector and thus not contributing to the total measured current, the total incoming power may be calculated by multiplying the measured absorbed current with the acceleration voltage. The maximum in power density will occur at the first impact of the electron beam with the electron collector. Electrons scattered from the first impact and becoming absorbed after subsequent impacts with the electron collector may do so with a lower power density, since at least some of the incoming electrons will be absorbed during the first impact and since the scattering will distribute the remaining electrons over a larger surface. Thus, the absorbed power during the first impact may be calculated by multiplying the total incoming power with an absorption probability determined by the material in the electron collector, the acceleration voltage, and the angle between the electron beam and the impact portion. To get the absorbed power density, the area, over which the electron beam impacts the impact portion, is needed. The area may be calculated from the shape of the electron beam cross section, the focusing angle, the distance from the focus to the impact portion, and the angle between the electron beam and the impact portion. The absorbed power density may then be calculated as the absorbed power divided by the area over which the electron beam impacts the impact portion.

The calculated absorbed power density may then be used as input for adjusting at least one of a focusing angle, angle of incidence, and power of the electron beam so as to keep the absorbed power density below a predetermined damage threshold. The focusing angle may for example be adjusted by means of an electron-optical system, whereas the angle of incidence may be adjusted by moving or tilting the electron collector.

The electron-optical system may further be employed to move the electron beam over the liquid target, such that the electron collector is at least partly obscured by the target during the scanning. The resulting signal detected at the electron collector may be used to calculate a size of the cross section of the electron beam.

The X-ray source according to the present invention may be implemented in a system comprising one or several processing means for processing and analysing data from sensors, such as the electron collector. The system may also comprise one or several controllers for operating different parts of the X-ray source, such the electron source, the liquid target source, and electron optics, in accordance with methods disclosed in the present application.

It will be appreciated that any of the features in the embodiments described above for the method according to some aspects may be combined with the device according to the other aspects.

Further objective of, features of, and advantages with the present invention will become apparent with studying the following detailed disclosure, the drawings and the appended claims. Those skilled in the art will realise that the different features of the present invention can be combined to create embodiments other than those described in the following.

BRIEF DESCRIPTION OF DRAWINGS

Embodiments of the present invention will now be described with reference to the accompanying drawings.

Like reference numeral are used for like elements on the drawings. Unless otherwise indicated, the drawings are schematic and not to scale.

DETAILED DESCRIPTION

Figure 1:
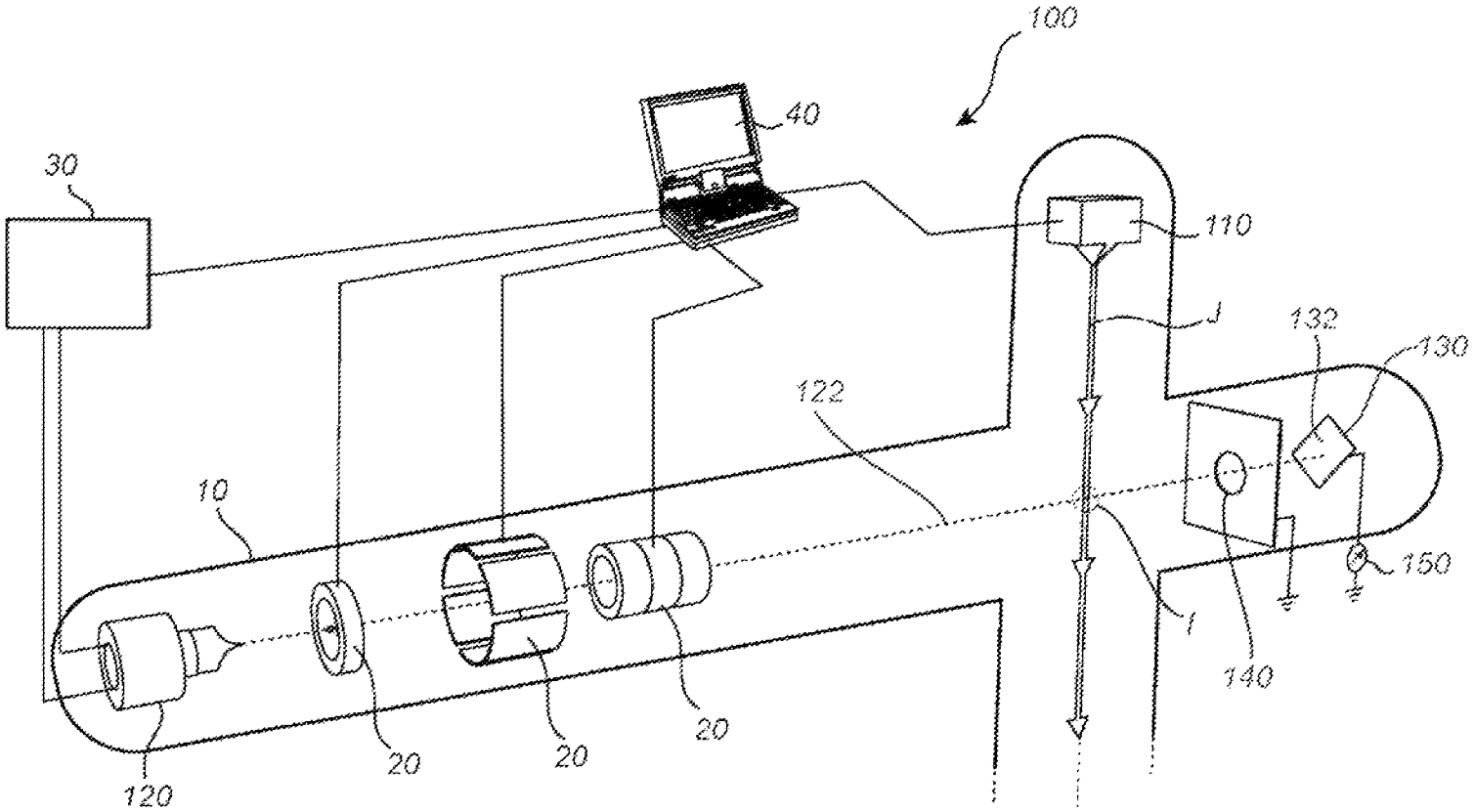
FIG. 1 is a diagrammatical perspective view of an X-ray source in accordance with an embodiment of the invention.

FIG. 1 shows an X-ray source 100, generally comprising a liquid target source 110, an electron source 120, and an electron collector 130. This equipment may be located inside a gas-tight housing 10, with possible exceptions for a voltage supply 30, sensor means 150 and controller means 40, which may be located outside the housing 10 as shown in the drawing. Various electron-optical components 20 functioning by electromagnetic interaction may also be provided so inside the housing 10, or located outside the housing 10 if the latter does not screen off electromagnetic fields to any significant extent.

The electron source 120 generally comprises a cathode which is powered by the voltage supply 30 and configured to generate an electron beam 122 which may be accelerated towards an accelerating aperture, at which point it enters an electron-optical system 20 comprising an arrangement of aligning plates, lenses and an arrangement of deflection plates. Variable properties of the aligning means, deflection means and lenses are controllable by signals provided by a controller 40. Although the drawing symbolically depicts the aligning, focusing and deflecting means in a way to suggest that they are of the electrostatic type, the invention may equally well be embodied by using electromagnetic equipment or a mixture of electrostatic and electromagnetic electron-optical components.

Downstream of the electron-optical system 20, an outgoing electron beam 122 intersects with a liquid target J, which may be produced by enabling a high-pressure nozzle of the liquid target source 110, at an interaction region I. This is where the X-ray production may take place. X-rays may be led out from the housing 10 in a direction not coinciding with the electron beam 122. The portion of the electron beam 122 that continues past the interaction region I reaches the electron collector 130 unless it is obstructed by a conductive screen provided with an aperture 140. In this embodiment, the screen is an earthed plate having a circular aperture 140 arranged between the interaction region I and the electron collector 130. The aperture 140 defines a clearly limited area, which can be used as a reference structure when aligning the electron beam 122 and for collecting electrons that are scattered off the electron collector 130. Furthermore, the aperture may prevent the electron beam from reaching the outermost edges of the electron collector. In some embodiments these outer edges may be thin and located a comparatively long way from any heat sink. Preventing electrons from impacting on these parts may be a way to protect these parts from thermal overload, e.g. melting. On the other hand, the aperture may be subject to high thermal load and require separate cooling (not shown).

The electron collector 130 comprises an impact portion 132 configured to absorb at least some of the electrons impinging thereon. The impact portion 132 may in this example be formed by a surface portion of the electron collector 130 facing the electron beam 122. The surface portion, defining the impact portion 132, may be arranged at an oblique angle with respect to the impact direction of the electron beam 122. In this example, the impact portion 132 may represent a slanting surface that is neither parallel nor orthogonal to the impact direction of the electron beam 122.

The electron collector 130 may be formed as a conductive plate that is electrically insulated from the rest of the system so as to allow the absorbed current to pass through the ammeter 150 to which it is connected. By studying the signal from the ammeter, the total number of absorbed electrons may be estimated. The angle of incidence, as measured relative a tangent to the surface of the impact portion, may be selected such that an absorbed power density is reduced compared to a normal incidence of the electron beam 122. The absorbed power density may for example be reduced by at least a factor five, depending on the actual obliqueness of the impact portion.

By tilting the impact portion 132 relative the electron beam 122, the impact area may be increased compared to normal incidence. A circular electron beam spot may for example be more elliptic as the incidence angle is reduced. Furthermore, the absorbed energy will be reduced as the angle is reduced. For normal incidence, about half of the incoming electrons may be absorbed whereas the other half is scattered off the surface. When the angle of incidence approaches 0°, the absorbed energy approaches zero; for incidence parallel to the surface of the impact portion there will be substantially no absorption at all.

Figure 2:
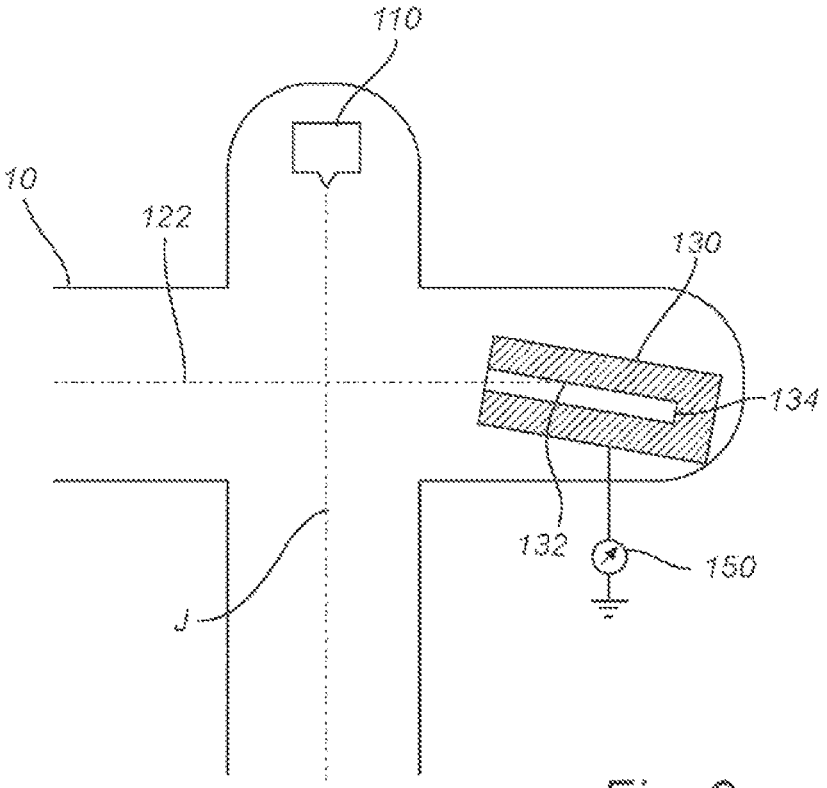
FIG. 2 is a diagrammatical cross section of a portion of an X-ray source according to an embodiment, disclosing the orientation of an electron collector.

FIG. 2 illustrate a portion of an X-ray source 100, which may be similarly configured as the embodiment disclosed in connection with FIG. 1. In the present example, the electron collector 130, which also may be referred to as an electron dump or electron sensor, may be formed of a body comprising a recess 134. The recess may, as shown in this example, be a bore 134 forming a blind hole in the body. The length axis of the bore 134 may be tilted in relation to the impact direction of the electron beam 122, such that the electron beam may impinge on an inner surface 132 of the bore 134. Preferably, the tilting angle of the electron collector 130 is selected such that the entire spot formed by the electron beam 122 can be accommodated by the impact portion formed by the inner wall 132 of the bore 134, such that no part of the cross section of the electron beam 122 reaches the bottom of the blind hole 134.

An additional function of the electron collector 130 may be to measure the amount of incoming electrons of the electron beam 122. This may be utilized when calibrating the system, and when measuring the electron spot size formed on the impact portion 132. For this case it is desirable to minimise the amount of electrons not absorbed by the electron collector 130, i.e., the number of electrons that are scattered off the impact portion 132. One way to achieve this may be allow the electron beam to enter a recess, such as the bore hole shown in FIG. 2. This effectively reduces the solid angle through which scattered electrons may escape from the collector 130. A straight hole 134 with a slanted bottom surface might not be a feasible solution, since the absorbed power density at the bottom of the hole may cause heating of the material until melting starts. The hole 134 may therefore be tilted, such that the impact portion is oblique with respect to the incoming electron beam 122, to thereby allow the electrons to impact on the inner wall 132 of the hole 134 and not on the bottom surface. Although the surface 132 where the electrons impact may be curved, e.g. in cases where the hole 134 has a circular symmetry, arguments similar to those outlined above will be applicable to other configurations as well.

The diameter of the hole 134 should be selected so that the entire electron beam 122 may impact on the inner wall 132 for all possible electron beam configurations. On the other hand, as discussed above the solid angle through which the scattered electrons are capable of escaping should be reduced as much as possible. To reconcile these requirements, a tapered entry hole may be provided. To further improve on the measurement capability an external aperture 140, such as the one disclosed in FIG. 1, may be provided. The aperture 140 may provide a well-known reference when scanning the electron beam into and out of the aperture 140.

For embodiments where the hole 134 is cylindrical, the requirement on the angle of the bore corresponding to that the electron beam should not directly impact the bottom of the hole may be expressed as a relation between a width and a length of the hole. For a circular cylinder, the relevant width is just the diameter of the bore. For other cylindrical geometries, the relevant width is defined by the direction of the bore. If the relevant width is denoted D and the length of the bore is denoted L, then the requirement on the angle between the electron beam and the bore is that it should be larger than $\tan^{-1}(D/L)$. In embodiments where the electron beam is scanned over the electron collector, the impact direction of the electron beam may vary slightly during the scan, and in such cases the condition should be fulfilled for all attainable impact directions to ensure that the electron beam does not directly impact the bottom of the hole.

Figure 3A:
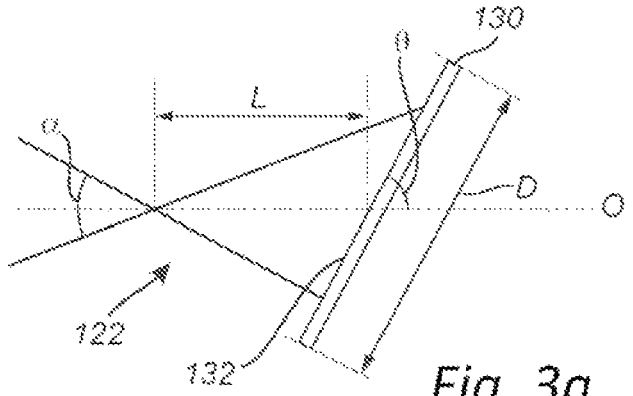
FIGS. 3*a-d* schematically illustrate various examples of electron collectors and the orientation of their impact portions.

FIG. 3*a* is a schematic illustration of the orientation of the tilting angle θ, or obliqueness, of the impact portion 132 of the electron collector 130 relative the impact direction of the electron beam, or, as in this example, the optical axis O of the electron-optical system. The electron beam 122 may have a focal point that is located upstream of the impact portion 132, at a distance L. The focus angle α may in this case together with the distance L determine the size of the electron spot as projected onto the impact portion 132. The size of the electron spot may in this example be smaller than the size D of the total available surface of the impact portion 132. A more detailed discussion about the relation between the absorbed electron energy, the focus angle α and the relative orientation and size of the impact portion will follow.

Figure 3B:
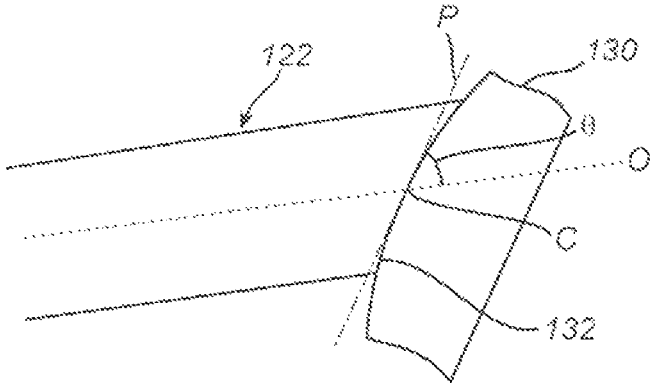

FIG. 3*b* illustrates a portion of an electron collector 130 having a curved impact portion 132. The tilting angle, or obliqueness θ of the impact portion 132 may be defined as the angle of incidence at a centre point C of the impact portion 132, or, in this case, the electron spot. The centre point C may be determined as the middle or centroid of the area defined by the electron spot. In FIG. 3*b*, the angle of incidence θ is shown as the angle between a tangent plane to the centroid and the impact direction O of the electron beam 122. In embodiments of the invention, it is advantageous to provide for an oblique impact also for a curved impact portion since the beam power will be distributed over a larger area as compared to a case where the impact direction is perpendicular to the tangent plane.

Figure 3C:
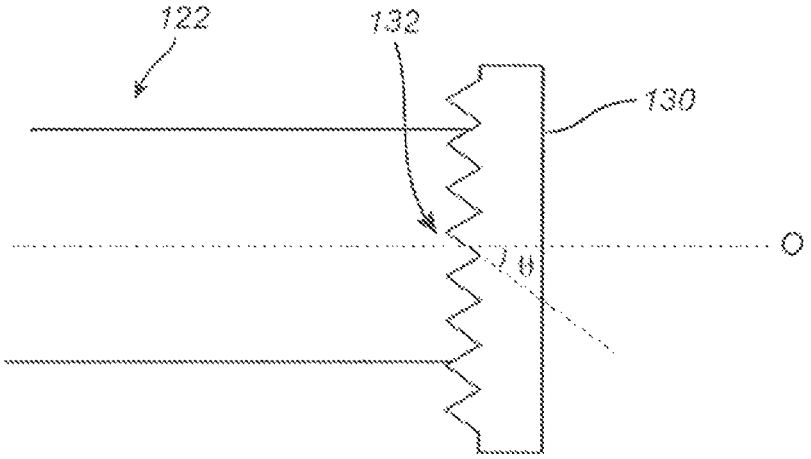

FIG. 3*c* shows an impact portion 132 of an electron collector according to an embodiment wherein the surface that the electron beam 122 is arranged to impact comprises multiple segments. Each segment is arranged to provide for an oblique impact of the electron beam. In the embodiment of FIG. 3*c*, the angle of incidence θ will have the same magnitude but differ in sign for consecutive segments. The result will be the same increase in area and backscattering as for a planar surface arranged for providing the same angle of incidence. An advantage of the embodiment shown in FIG. 3*c* may be that it requires less volume as compared to a planar surface provided at an angle towards the impact direction O.

Figure 3D:
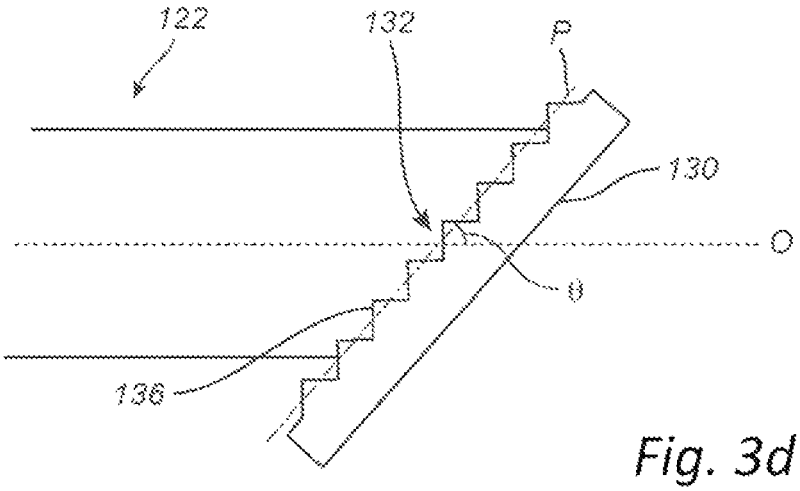

FIG. 3*d* shows an impact portion 132 of an electron collector according to an embodiment, which may be similarly configured as the electron collectors discussed in connection with FIGS. 1, 2, 3*a* and 3*b*. The impact portion 132 may be provided with a surface structure, such as steps 136, forming a folded surface of the impact portion 132. In this case, the angle of incidence θ may be defined as the angle between the electron beam 122 and an average plane P (or surface) fitted to the surface of the impact portion 132. Similar to the cases described above, the tilting of the impact portion 132 may be characterised by the angle of incidence θ at the middle of the surface (or plane) P. This embodiment is a combination of an embodiment where a structured surface is provided on the impact portion and an embodiment where the impact portion is provided at an oblique angle with respect to the impact direction. Provided that the structures are sufficiently small, this combination may result in a situation where the projected area of the electron beam on the electron collector is determined by the angle of incidence whereas the probability for backscattering will be determined by the local impact angle. The local impact angle will be affected both by the angle of incidence and the surface structures. For the particular embodiment shown in FIG. 3*d* one may note that the electrons may locally impact perpendicularly to the surface thus effectively reducing the probability for backscattering as compared to other angles of incidence θ. Thus, this configuration may absorb a larger fraction of the incoming electrons, and consequently more energy, than would be the case for the same surface provided in another orientation. The orientation of the surface will also determine the area of the impact portion that contributes to the distribution of the thermal load caused by the absorbed electrons. The skilled person will find suitable combinations of surface structures and angles of incidence to ensure measurement accuracy and thermal management within the allotted space.

Figure 4:
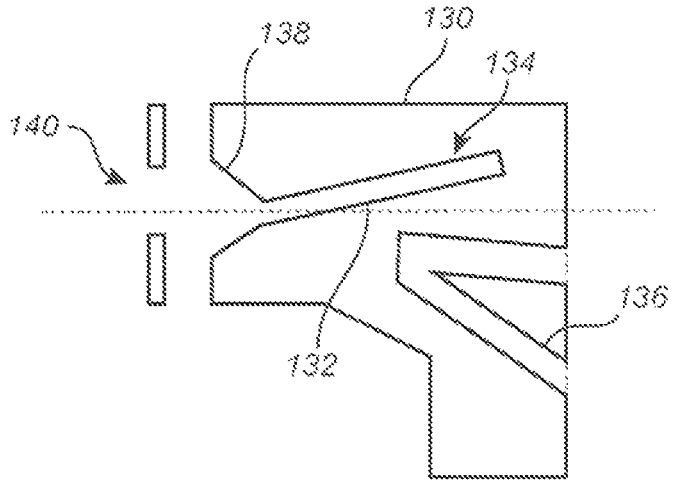
FIG. 4 is a cross sectional view of an electron collector of an X-ray source according to an embodiment.

Despite all these efforts to distribute the electron beam power over the electron collector 130, there may still be need to further improve the thermal management of the X-ray source. This may for example be achieved by actively cooling the electron collector 130. FIG. 4 shows an example of an electron collector 130, which may be similarly configured as the embodiments in FIGS. 1-3*d*, wherein the impact portion 132 is provided in a body with a relatively large heat capacity. The body may further be provided with a cooling arrangement, such as channels 136, through which a coolant may be pumped through the body. If the absorbed current needs to be measured, the cooling arrangement may be electrically isolated from the electron collector body so as not to disturb the measurements. One possibility may be to electrically isolate the cooling components from the rest of the system and provide a non-ionic coolant (e.g. de-ionized water). To achieve measurements of the number of electrons received by the electron collector that are robust against changes in coolant resistance may require some attention during the electronics design, which the skilled person will be able to address without any inventive efforts.

The illustrated example of the electron collector 130 further includes an aperture 140 and a slanted surface 138 for guiding electrons into the bore 134, which extends at a non-zero and non-orthogonal angle to the impact direction O of the electron beam so as to provide an impact portion 132 that is obliquely arranged. The aperture may be electrically insulated from the impact portion so as to ensure that the measured absorbed current is governed by the electrons passing through the aperture.

As already mentioned, the number of scattered electrons may increase with a reduced angle of incidence θ. As a consequence, the absorbed energy may be expressed as a function of the angle of incidence θ. The behaviour may be modelled as a sinus function, wherein the absorbed energy may be set to a constant times the incoming energy times the sine of the angle of incidence θ. For cases where the electron beam 122 is not circular, e.g., where a line focus is applied, it may be advantageous to provide the slanting surface 130 arranged so that the smaller dimension of the electron spot is drawn out.

The size of the surface of the impact portion 132 may in all practical cases be finite. This means that there is a lower limit for the angle of incidence θ. Since it is a purpose of the electron collector 130 to absorb the electrons of the electron beam 122, it is preferred that the entire beam 122 fits within the impact portion 132. For an infinite surface it would be enough to have an angle of incidence θ that is larger than half the focus angle α (please refer to FIG. 3*a*). However, for a surface with a finite size, say D, the angle of incidence θ should be larger according to:

$$\theta > \frac{\alpha}{2}\left(1 + \frac{2L}{D}\right);$$

where L is the distance from the electron beam focus to the centre of the electron collector.

To have an upper limit of the angle of incidence θ, one may consider that the power density may be reduced by at least some factor compared to normal incidence. Assuming a circular cross section of the incoming electron beam 122, the projected cross section on the impact portion will be an ellipse with an impact area A on the electron collector 130 which may be expressed as:

$$A = \pi L^2 \tan\frac{\alpha}{2}\frac{\sin\frac{\alpha}{2}}{\sin\left(\theta - \frac{\alpha}{2}\right)}$$

For θ equal to π/2 this reduces to:

$$A = \pi L^2 \tan^2\frac{\alpha}{2}.$$

With this expression for the impact area A, the absorbed power density p may be expressed as a function of angle of incidence θ:

$$p(\theta) = \frac{P_0}{A}\mathbf{C}\sin\theta = \frac{P_0\mathbf{C}\sin\theta\sin\left(\theta - \frac{\alpha}{2}\right)}{\pi L^2 \tan\frac{\alpha}{2}\sin\frac{\alpha}{2}}$$

where $P_0$ is the total beam power and C is the absorption fraction, which will at least in principle may depend on the electron energy, i.e. the acceleration voltage. The reduction in power density as a function of incidence angle θ may be calculated as:

$$\frac{p(\theta)}{p\left(\frac{\pi}{2}\right)} = \frac{\sin\theta\sin\left(\theta - \frac{\alpha}{2}\right)}{\cos\frac{\alpha}{2}}$$

Figure 5:
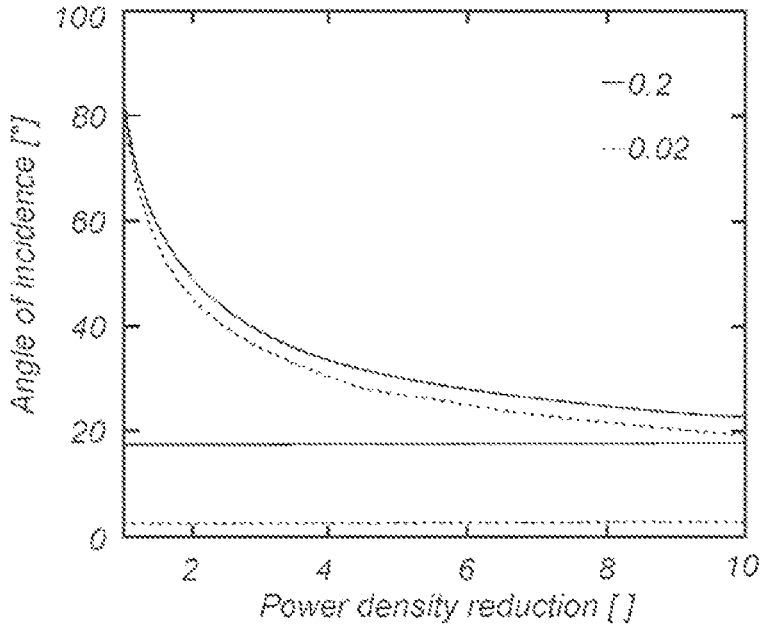
FIG. 5 is a diagram showing relations between power density reduction and angle of incidence.

FIG. 5 is a diagram visualising the maximum allowed angle of incidence θ for a given desired reduction factor. To visualize the lower bound on the angle θ in the same plot, the assumption that the size of the electron collector surface 132 is of the same order as the distance between the electron beam focus and the electron collector L. The lower bound on the angle may then be approximated as 1.5 times the focus angle.

A focus angle α of 0.02 radians (dashed in FIG. 5) may be considered as a small angle; it is limited by the cathode brightness and a desire to have a spot size below 20 μm. A focus angle α of 0.2 radians (solid line in FIG. 5) may be considered as large angle; it is limited by spherical aberrations with current electron optics components. To increase the focus angle α further may require more complicated electron optics like multipole correctors.

The above calculations can serve as a basis for configuring the X-ray source. In particular, the above disclosed angles of incidence can be used in order to achieve a particular power density reduction. The angle of incidence may according to some embodiments be adjusted by manually or automatically adjusting the orientation of the impact portion, by modifying the alignment or orientation of the electron beam, and/or by varying the focus angle of the electron beam.

Figure 6:
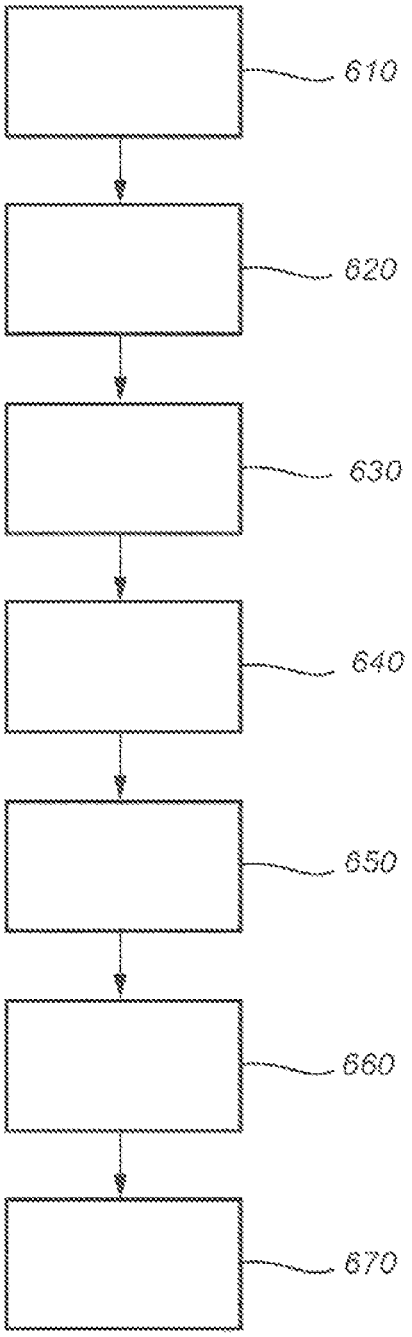
FIG. 6 is a flow chart illustrating a method according to an embodiment of the invention.

FIG. 6 is a flow chart of a method according to some embodiments of the present invention. The method may be performed in an X-ray source according to any one of the previous embodiments described with reference to FIGS. 1 to 5, and may comprise the steps of:

directing 610 the electron beam towards the interaction region;

impacting 620 the electron beam on the impact portion of the electron collector;

measuring 630 a current generated by the impacting electron beam;

calculating an absorbed power density delivered by the electron beam;

adjusting 640 at least one of a focusing angle and power of the electron beam so as to keep the absorbed power density below a predetermined threshold;

moving 650 the electron beam over the liquid target;

measuring 660 a current generated by the impacting electron beam; and calculating 670, based on the moving and measuring, a spot size of the electron beam.

The technology disclosed herein, such as the exemplary method outlined in FIG. 6, may be embodied as computer-readable instructions for controlling a programmable computer in such manner that is causes an X-ray source according to any one of the herein disclosed embodiments to perform any of the methods defined by the claims. Such instructions may be distributed in the form of a computer-program product, comprising a tangible and non-volatile computer readable medium storing the instructions.

The person skilled in the art is by no means limited to the example embodiments described above. On the contrary, many modifications and variations are possible within the scope of the appended claims. In particular, X-ray sources and systems comprising more than one target or more than one electron beam are conceivable within the scope of the present inventive concept. Furthermore, X-ray sources of the type described herein may advantageously be combined with X-ray optics and/or detectors tailored to specific applications exemplified by but not limited to medical diagnosis, non-destructive testing, lithography, crystal analysis, microscopy, materials science, microscopy surface physics, protein structure determination by X-ray diffraction, X-ray photo spectroscopy (XPS), critical dimension small angle X-ray scattering (CD-SAXS), and X-ray fluorescence (XRF). Additionally, variation to the disclosed examples can be understood and effected by the skilled person in practicing the claimed invention, from a study of the drawings, the disclosure, and the appended claims. The mere fact that certain measures are recited in mutually different dependent claims does not indicate that a combination of these measures cannot be used to advantage.

The invention claimed is:

1. An X-ray source comprising:

a liquid target source configured to provide a liquid target in an interaction region of the X-ray source;

an electron source adapted to provide an electron beam directed towards the interaction region, such that the electron beam interacts with the liquid target to generate X-ray radiation;

an electron collector arranged at a distance downstream of the interaction region, as seen along a travel direction of the electron beam;

wherein:

the electron collector comprises an impact portion configured to absorb electrons of the electron beam impinging thereon; and the impact portion is arranged so as to be oblique with respect to the travel direction of the electron beam at the impact portion;

wherein the impact portion forms part of an inner surface of a recess extending into the electron collector; and the recess is oriented so as to prevent the electron beam from directly impinging on a bottom of the recess.

2. The X-ray source according to claim 1, wherein the impact portion is formed of a surface having a normal that is oblique with respect to the travel direction of the electron beam at the impact portion.

3. The X-ray source according to claim 1, wherein the impact portion comprises a surface structure for reducing an absorbed power density delivered by the impinging electron beam.

4. The X-ray source according to claim 1, wherein the impact portion is arranged so as to allow the electron beam to impinge thereon at an angle of incidence selected such that an absorbed power density is reduced by at least a reduction factor compared to the impact portion being orthogonal to the travel direction at the impact portion.

5. The X-ray source according to claim 4, wherein the reduction factor is at least 5.

6. The X-ray source according to claim 4, wherein the angle of incidence is in the range from 1.5 degrees to 30 degrees.

7. The X-ray source according to claim 1, wherein the impact portion is configured to accommodate the entire cross section of the electron beam.

8. The X-ray source according to claim 1, wherein the recess is a bore forming a blind hole in the electron collector.

9. The X-ray source according to claim 1, wherein the recess is arranged such that the probability for an incoming electron to escape the electron collector is lowered compared to an electron collector without such a recess.

10. The X-ray source according to claim 1, further comprising an aperture arranged upstream of the entrance of the recess, wherein a cross section of the aperture is smaller than a cross section of the recess.

11. The X-ray source according to claim 1, further comprising a cooling arrangement for transporting away heat from the electron collector, wherein the cooling arrangement comprises a cooling channel for guiding a cooling fluid through the electron collector.

12. The X-ray source according to claim 1, further comprising an arrangement for measuring a current absorbed by the electron collector.

13. A method in an X-ray source configured to generate X-ray radiation upon interaction, in an interaction region, between an electron beam and a liquid target, comprising:

directing the electron beam towards the interaction region; and impacting the electron beam on an impact portion of an electron collector arranged at a distance downstream of the interaction region, as seen along a travel direction of the electron beam; wherein:

the impact portion is oblique with respect to the travel direction of the electron beam at the impact portion and forms a part of an inner surface of a recess extending into the electron collector; and the recess is oriented so as to prevent the electron beam from directly impinging on a bottom of the recess.

14. The method according to claim 13, further comprising:

measuring a current generated by the impacting electron beam;

calculating an absorbed power density delivered by the electron beam; and adjusting at least one of a focusing angle and power of the electron beam so as to keep the absorbed power density below a predetermined threshold.

15. The method according to claim 13, further comprising:

moving the electron beam over the liquid target;

measuring a current generated by the impacting electron beam; and calculating, based on said moving and measuring, a spot size of the electron beam.

* * * * *